United States Patent [19]

Ogg

[11] Patent Number: 4,548,441

[45] Date of Patent: Oct. 22, 1985

[54] STACKING CHAIR

[76] Inventor: Richard K. Ogg, c/o Keneco, R.R. 3, Box 34, Littlestown, Pa. 17340

[21] Appl. No.: 341,624

[22] Filed: Jan. 22, 1982

[51] Int. Cl.[4] ..... A47C 3/04

[52] U.S. Cl. ..... 297/239; 297/457

[58] Field of Search ..... 297/239, 452, 457, DIG. 2

[56] References Cited

U.S. PATENT DOCUMENTS

| | | | |
|---|---|---|---|
| Re. 26,071 | 8/1966 | Rowland . | |
| D. 202,775 | 11/1965 | Rowland . | |
| 1,993,601 | 3/1935 | Goldberg . | |
| 3,057,661 | 10/1962 | Moxley | 297/239 X |
| 3,173,723 | 3/1965 | Hoven et al. | 297/DIG. 2 |
| 3,245,715 | 4/1966 | Gits . | |
| 3,278,227 | 10/1966 | Rowland . | |
| 3,393,941 | 7/1968 | Grosfillex . | |
| 3,734,561 | 5/1973 | Barecki et al. | 297/239 |
| 3,838,884 | 10/1974 | Faiks et al. . | |
| 3,847,433 | 11/1974 | Acton et al. . | |
| 4,088,367 | 5/1978 | Atkinson et al. | 297/457 |

FOREIGN PATENT DOCUMENTS

| | | | |
|---|---|---|---|
| 2535911 | 2/1977 | Fed. Rep. of Germany | 297/239 |
| 524397 | 8/1940 | United Kingdom | 297/239 |

*Primary Examiner*—Francis K. Zugel

*Attorney, Agent, or Firm*—Cushman, Darby & Cushman

[57] ABSTRACT

A chair is provided that includes first and second integral tubes that define the front legs, seat perimeter, and back perimeter of the chair. An integral rod is provided which cooperates with openings in the first and second tubes to provide the rear legs and leg supports for the chair in a simple manner. The rod is welded to the tubes at the areas where it cooperates with openings in the tubes, to achieve good stability high dimensional control. The rod ends are shaped so that the rear legs and side leg supports are exterior of a volume defined by planes containing the first and second tubes, to provide for stackability of the chair. The chair seat and back preferably are of injection molded plastic, the seat having integral ribs formed on the bottom thereof to control its flexibility at various points.

15 Claims, 8 Drawing Figures

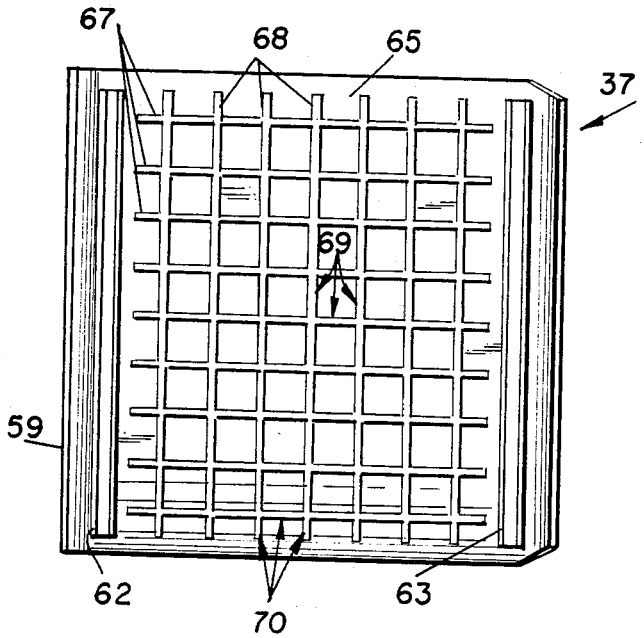
Fig. 7
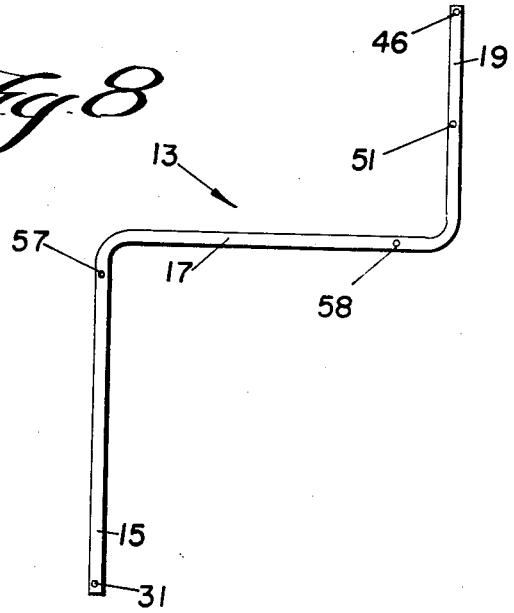
Fig. 8
Fig. 6
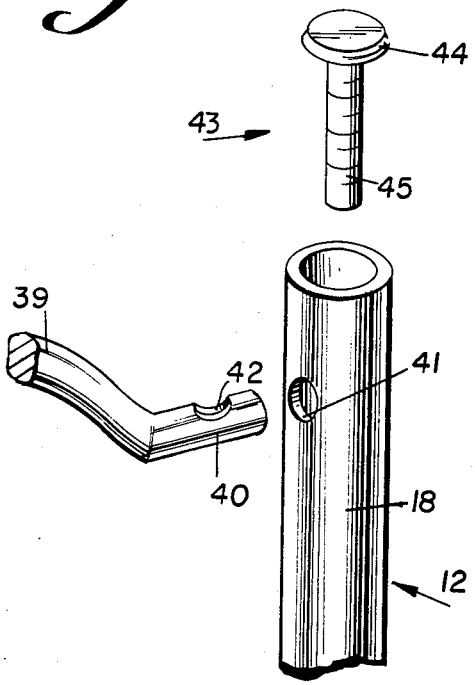

STACKING CHAIR

BACKGROUND AND SUMMARY OF THE INVENTION

For many particular uses, such as to provide audience seatings for public gatherings, it is desirable to provide non-folding, sturdy, lightweight chairs. The chairs preferably are compactly stackable for storage, and are attachable together in rows. While being lightweight and strong, it is also desirable to construct such chairs with a minimum amount of material and in as simple a manner as possible.

According to the present invention, a chair is provided that is eminently suited for use in auditoriums, gymnasiums, and in any other environment where a sturdy lightweight chair is desirable. A chair according to the present invention is constructed from a minimum of components, and the construction thereof is simple to effect, yet the chair has good stability, and can be constructed to very exacting dimensions. Preferably the chair according to the present invention is stackable, so that a large number of chairs may be disposed in a minimum volume for storage (e.g., according to the present invention stacks of 33 chairs per meter of height are possible).

Basic components of a chair according to the present invention include: Substantially identical first and second integral tubes, each having a front leg-forming portion, seat perimeter-forming portion, and back perimeter-forming portion, with the leg and back-forming portions being generally parallel and perpendicular to the seat perimeter-forming portions. A back, which preferably is of injection molded plastic, is operatively supported by the tube back perimeter-forming portions, and a seat—also preferably of injection molded plastic—is supported by the tube seat perimeter-forming portions. Secondary support rods may be provided extending between the tubes to facilitate support of the seat and back.

The rear legs and leg supports of the chair are provided by rod components. Preferably a single integral rod is utilized having a pair of spaced parallel rear leg-forming portions adjacent the ends thereof, with first, second, and third support portions between the rear leg-forming portions. The first and third support portions are generally parallel to each other and generally transverse to the rear leg-forming portions, while the second support portion is generally transverse to the first and third support portions and disposed therebetween. The second support portion passes through through-extending openings formed in the tube front leg-forming portions, and the rod and tubes are affixed together at this area, by welding or the like.

Each end of the integral rod includes an inturned portion which passes into a cooperating opening therefor formed in one of the tubes, the inturned portions being long enough so that the first and third supports of the integral rod, and the rear leg-forming portions, are everywhere outside a volume defined by planes containing the tubes, so that the chair is stackable with like chairs. This construction allows a large number of chairs to be stacked in a relative small volume, e.g., 33 chairs per meter of height.

The secondary support rods for the seat also preferably pass into openings in the tubes, and are welded in place. The seat itself has integral ribs formed on the bottom thereof, the ribs varying in thickness to control the flexibility of the seat. For instance at center portions of the seat, the ribs (which are preferably in the form of a square grid) are thinnest to provided maximum flexibility.

The chair back is preferably attached to an upper support rod which has ends with threaded openings which pass into the tubes. A screw passes into the top of each of the tubes to engage a threaded opening in the upper back support rod to hold it in place, and simultaneously cap the tube. The bottom of the back is preferably held in place by plastic plugs that extend inwardly from the back into openings formed in the tubes.

It is the primary object of the present invention to provide a simple to construct yet sturdy chair, particularly one that is readily stackable. This and other objects of the present invention will become clear from an inspection of the detailed description of the invention and from the appended claims.

BRIEF DESCRIPTION OF THE DRAWINGS

FIG. 6 is a detail perspective exploded view illustrating components that interact to attach the back to the frame of the chair of FIG. 1;

FIG. 7 is a bottom plan view of the seat of the chair of FIG. 1; and

FIG. 8 is a side view of one of the tubular components of the frame of the chair of FIG. 1.

DETAILED DESCRIPTION OF THE DRAWINGS

Figure 5:
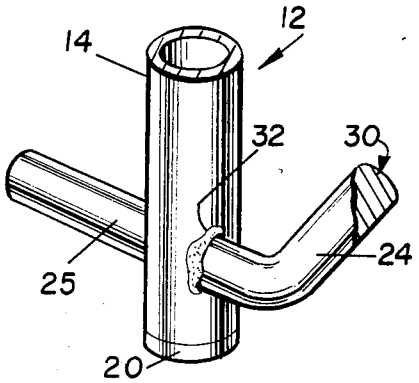
FIG. 5 is a detail perspective view of the interengagement between tube and rod components of the chair of FIG. 1.

An exemplary chair according to the present invention is shown generally by reference number 10 in the drawings. Basic components of the chair include first and second integral tubes 12, 13. Each of these tubes includes a front leg-forming portion 14, 15, resepctively; a seat perimeter-forming portions 16, 17, respectively; and a back perimeter-forming portion 18, 19, respectively. The portions 14, 18 and 15, 19, respectively, are generally parallel to each other, and generally transverse to the portion 16, 17, respectively. The tubes 12, 13 preferably are made of metal, such as tube steel, and have ground-engaging caps 20, 21 disposed on the ends of the leg-forming portions 14, 15, respectively, thereof. The tubular nature of the components 12, 13 is made clear in FIG. 5.

The rear legs of the chair 10 preferably are formed by first and second rear leg-forming rods 22, 23. Preferably these rods 22, 23 are parts of a single integral rod which includes in addition to the rear leg-forming portions 22, 23, first, second, and third leg support portions 24, 25, 26, respectively. In order to facilitate stackability of the chairs 10, preferably inturned portions 28, 29 (see FIG. 2 in particular) are provided at the ends of the integral rod (shown generally by reference numeral 30) which pass into cooperating openings formed in the back perimeter-forming portions 18, 19, respectively, of the first and second tubes 12, 13. The inturned portions are long enough so that the first and third supports 24, 26 and the rear leg-forming portions 22, 23 are everywhere outside a volume defined by planes containing the tubes 12, 13. This is clear in FIG. 2. The second support portion 25 also is long enough to allow this relative relationship between the first and second support portions 24, 26, rear leg portions 22, 23 and first and second tubes 12, 13.

Figure 1:
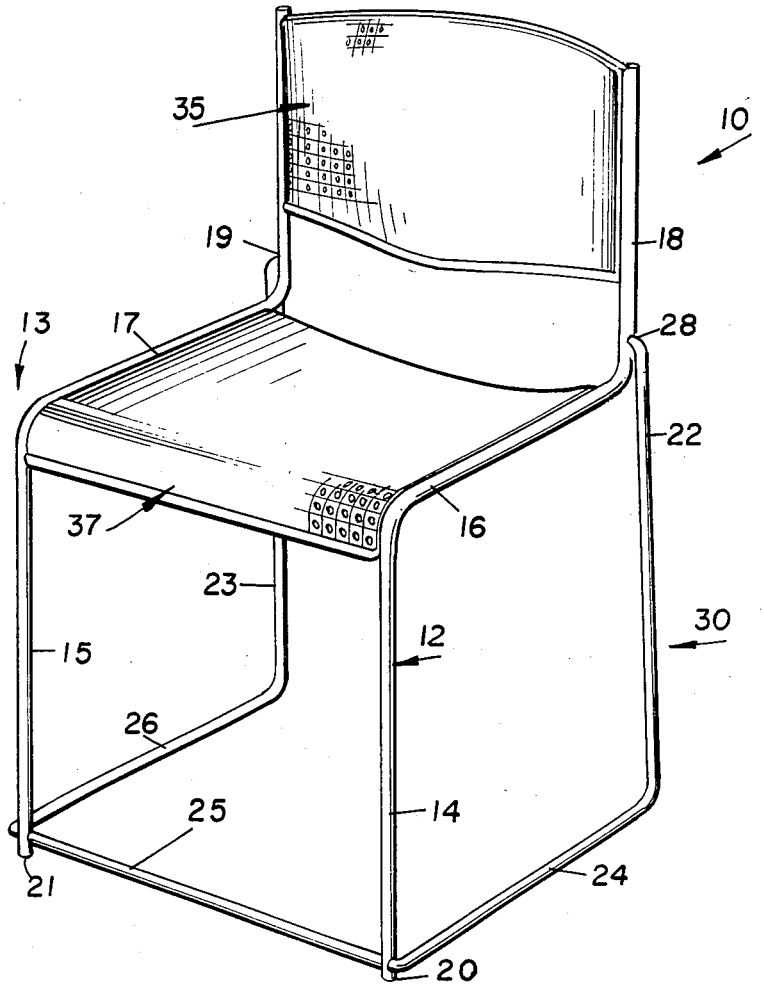
FIG. 1 is a front perspective view of an exemplary chair according to the present invention.

In order to provide dimensional stability and control, the integral rod 30—particularly and preferably second support portion 25 thereof—is received by through-extending openings formed in the front leg-forming portions 14, 15 of the tubes 12, 13, respectively. This can be seen clearly in FIGS. 1 and 2, and is illustrated specifically in FIG. 5.

Attachment means are provided for affixing the integral rod 30 to the tubes 12, 13 at the openings in the tubes for receipt of the rods—that is at the openings for the inturned ends 28, 29, and the openings for receipt of the second support portion 25 (e.g. see opening 31 in FIG. 8). The attachment means preferably comprises welds, such as weld 32 illustrated in FIG. 5—particularly where the tubes 12, 13 and the rod 30 are metal, such as steel.

The chair 10 further includes a back 35 operatively supported by the tube portions 18, 19, and a seat 37 operatively supported by the tube portions 16, 17. The back and seat preferably are formed of injection molded plastic, and are mounted so that they are completely within the volume defined by planes containing the tubes 12, 13.

Figure 3:
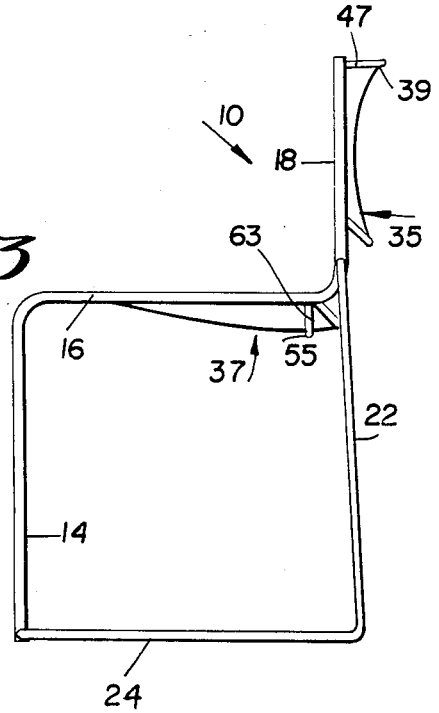
FIG. 3 is side view of the chair of FIG. 1.
Figure 2:
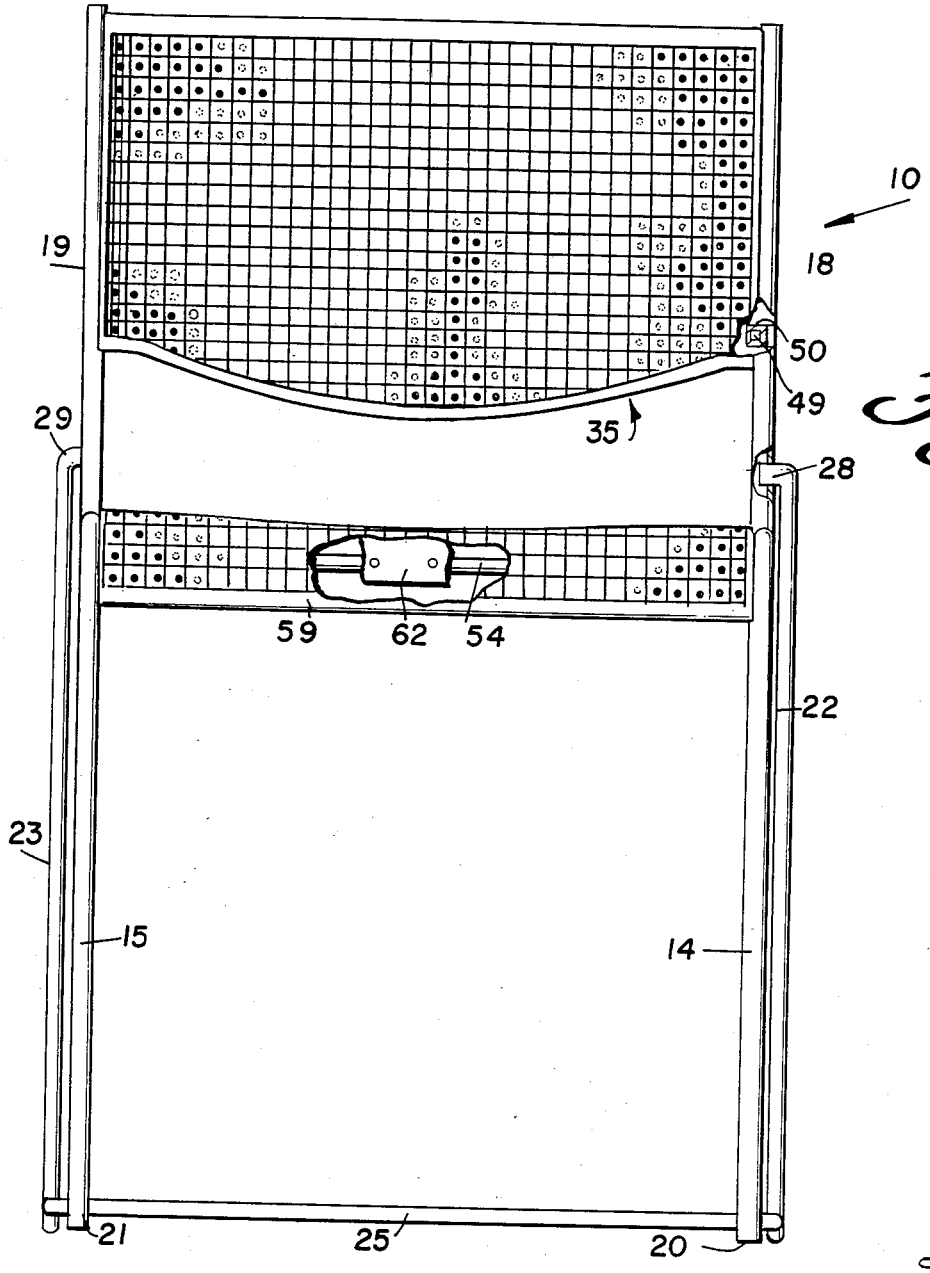
FIG. 2 is a front view of the chair of FIG. 1, with portions cut away to illustrate underlying components.

One suitable manner for attaching the back 35 is illustrated in FIGS. 2, 3, and 6. An upper back support rod 39 (see FIGS. 3 and 6 in particular) is contoured so that it has the same shape as the back 35, and has two ends—only the end 40 being llustrated in FIG. 6, but the opposite end being a mirror image—adapted to cooperate with openings formed in the tubes 12, 13, such as the opening 41 in tube 12 illustrated in FIG. 6. This upper back rod also may be referred to as a secondary support rod. This rod spaces the tubes 12, 13 (specifically the portions 18, 19 thereof) while at the same time supporting the back 35.

Attaching means for attaching the rod 39 to the tubes 12, 13 preferably comprises a mechanical attachment arrangement rather than a weld. An exemplary mechanical attachment is illustrated in FIG. 6. A threaded opening 42 is provided in the portion 40 of rod 39 that will pass through opening 41. A fastener 43, including a head 44 and a threaded shank 45, is adapted to cooperate with the opening 42 and the tube 12. Particularly, the shank 45 has a small enough diameter to pass into interior opening of the tube 12, and the threads thereon cooperate with the threads in opening 42 to lock the elements together. The head 44 abuts the top of the tube 12 when the shank 45 is threaded into proper position, and provides a cap for the tube 12. A similar fastener is assocated with the other end of rod 39, and tube 13. See opening 46 (FIG. 8) which receives the end of rod 39 opposite end portion 40.

The seat back 35 may be attached to the rod 39 in any suitable manner. For instance, the top of the back may have means defining a resilient snap-fit connector, shown generally by reference numeral 47 in FIG. 3, that resiliently passes over the rod 39 and then snaps in place.

The back 35 also is preferably connected to the frame components by integral lugs formed at the bottom thereof and cooperating with openings formed in the tubes 12, 13. An exemplary such lug is illustrated by reference numeral 49 in FIG. 2, passing through an opening 50 formed in first tube back perimeter-forming 18. A similar lug on the opposite side cooperates with a similar opening in second tube 13 (such as opening 51 illustrated in FIG. 8). Further, the side edges of the back 35 may be pop riveted to the tubes 12, 13 at spaced locations.

The seat 37 is seen most clearly in FIGS. 1, 2, 3, and 7. The seat 37 is preferably affixed to the tubes 12, 13 by cooperations with a number of secondary support rods, for instance, the front and rear support rods 54, 55 illustrated in FIGS. 2 and 3, respectively. Each of these rods 54, 55 extends between the tubes 12, 13 and passes into cooperating openings formed in the tubes 12, 13 for receipt thereof. Attachment between the rods 54, 55 and the tubes 12, 13 also is facilitated by attachment means, such as welds. The rod 54 preferably is substantially straight, and cooperates with openings formed in the leg-forming portions 14, 15 of the tubes 12, 13—see opening 57 in tube 13 in FIG. 8—while the rear secondary support rod 55 is curved to correspond to the contour of the seat 37 and cooperates with openings in the seat perimeter-defining portions 16, 17 of the tubes 12, 13—such as opening 58 in second tube 13 as seen in FIG. 8. Preferably the seat 37 includes a front lip 59 which extends downwardly and covers the rod 54.

The seat 37 may be affixed to the rods 54, 55 by any suitable means such as snap-fit connections integrally formed with seat 37. A portion of the front snap connector 62 is illustrated in FIG. 2, while the entire connector 62 is seen in plan view in FIG. 7. A similar rear snap connector 63 is also illustrated in FIG. 7. Snap connectors of similar type (although not continuous) are illustrated by reference numerals 60, 62 in U.S. Pat. No. 3,245,715.

The seat 37 also may be attached to the frame components by pop riveting the side edges of the seat 37 to the tubes 12, 13 (particularly the seat perimeter-forming portions 16, 17 thereof).

The seat 37 is preferably constructed so that it has different flexibility at different portions thereof. For instance, it is desirable to have a fair amount of flexibility at the center portions of the seat 37, while perimeter portions thereof desirably have little flexibility. This desirable result is accomplished according to the present invention by providing integrally molded structural ribs on the bottom face 65 (see FIG. 7) of the seat 37. These ribs preferably are in the form of a square grid as illustrated in FIG. 7, including a first set of ribs 67 generally parallel to the side portions of the seat 37, and a second set of ribs 68 generally parallel to the front lip 59 of the seat 37. The ribs 67, 68 have varying thickness (that is they extend from the bottom face 65 varying distances). For instance at center portions of the seat 37, illustrated generally by reference numeral 69, the ribs 67, 68 will have minimum thickness (e.g., one-eighth inch), while at perimeter portions of the seat 37 (e.g., indicated by reference numeral 70 in FIG. 7) the ribs 67, 68 will have maximum thickness (e.g., one-half inch). The body of the seat 37 preferably has substantially the same thickness throughout.

Figure 4:
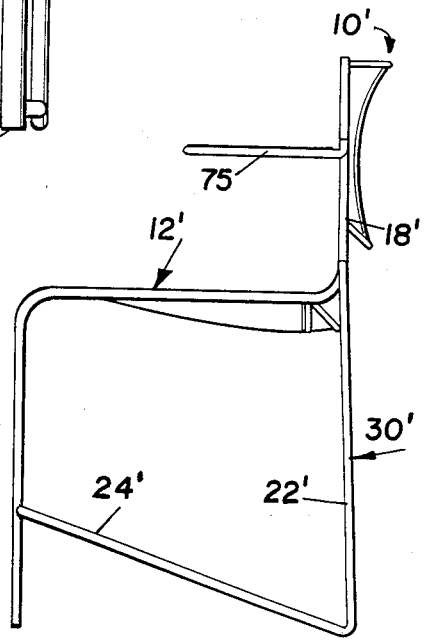
FIG. 4 is a side view of a modified form of an exemplary chair according to the present invention.

The chair according to the present invention may take a wide variety of forms aside from those illustrated in the drawings. For instance while the various portions of the rod 30 and tubes 12, 13 are preferably transverse to each other, clearly an actual 90° angle therebetween is not at all necessary. For instance in the embodiment of FIG. 4, the portions 22', 24' of the rod 30' make a much smaller angle with respect to each other. All such modifications are within the scope of the terms "generally transverse" and "generally perpendicular" used in the specification and claims. Further, while the rod 30 and the secondary support rods 39, 54, 55 preferably are solid (see FIG. 5), in fact under some circumstances they also could be tubular, and the term "rod" is to be interpreted to cover such a modification. Further, as illustrated in FIG. 4, accessory structures may be associated with the frame components, such as chair arm 75 attached to first tube 12' back perimeter-forming portion 18' in the chair 10' of the FIG. 4 embodiment. Also, while the various frame components are preferably circular in cross-section and have been illustrated as such, it is to be understood that the terms "tube" and "rod" encompass components of other cross-sectional configurations.

The provision of the simple, few, tube and rod frame components for the chair 10 according to the present invention makes fabrication and assembly of the chair 10 very simple. Yet, the cooperation between the rod components and openings formed in the tubes 12, 13 facilitate excellent stability and strength of the chair, and good dimensional control. The design of the seat and back attachments also facilitate ease of construction while providing good stability, while the design of the seat facilitates stackability and minimizes the amount of material necessary, while achieving appropriate variation of the flexibility of various seat portions. The construction in general also provides a chair that is readily stackable, so that a maximum number of chairs can be provided in a minimum volume (e.g., 33 chairs within a volume 3 meters in height).

While the invention has been herein shown and described in what is presently conceived to be the most practical and preferred embodiment thereof, it will be apparent to those of ordinary skill in the skill in the art that many modifications may be made thereof within the scope of the invention, which scope is to be accorded the broadest interpretation of the appended claims so as to encompass all equivalent structures and devices.

What is claimed is:

1. A chair comprising:

a first integral tube having a front leg-forming portion, seat perimeter-forming portion, and back perimeter-forming position, said front leg-forming and back perimeter-forming portions being generally parallel to each other and generally perpendicular to said seat perimeter-forming portion;

a second integral tube substantially identical to said first tube;

an integral rod including a pair of spaced parallel rear leg-forming portions adjacent the ends thereof, and first, second, and third support portions between said rear leg-forming portions, said first and third support portions being generally parallel to each other and generally transverse to said rear leg-forming portions, and said second support portion being generally transverse to said first and third support portions, and disposed therebetween;

means defining a through-extending opening in each of said first and second tube front leg-forming portions through which a support portion of said integral rod passes;

a back operatively supported by said first and second tube back perimeter-forming portions;

a seat operatively supported by said first and second tube seat perimeter-forming portions;

means defining an opening in each of said first and second integral tubes for passage of an end of said integral rod into said respective tube; and attachment means for affixing said integral rod to said first and second tubes at the openings in said tubes for receipt of said rod; and wherein operative attachment between said back and said first and second tube back perimeter-forming portions is provided in part by: a pair of plugs integral with said back, one extending outwardly from each side of said back; and means defining an opening in each of said first and second integral tube back perimeter-forming portions for receipt of a said plug.

2. A chair as recited in claim 1 wherein said attachment means comprises a weld at each opening for receipt of said rod.

3. A chair as recited in claim 1 wherein each end of said integral rod comprises an inturned portion, said inturned portion passing into the opening formed therefor in either of said first or second tubes, and said inturned portion being long enough so that said first and third supports and said rear leg-forming portions are everywhere outside a volume defined by planes containing said first and second tubes, so that the chair is stackable with like chairs.

4. A chair as recited in claims 1 or 3 further comprising a plurality of secondary support rods extending between said first and second tubes; means for supporting said seat and back on said secondary support rods; means defining an opening in each of said first and second integral tubes for receipt of the ends of each of said secondary support rods; and attachment means for affixing said secondary rods to said first and second tubes at the opening in said tubes for receipt thereof.

5. A chair as recited in claim 4 wherein one of said secondary support rods comprises an upper back support rod; and wherein said attachment means for said upper back support rod comprises: means defining a threaded opening in each end of said upper back support rod; a mechanical fastener for each tube, each fastener including a head and a threaded shank, said shank having a diameter smaller enough to fit within the interior cross-sectional dimensions of its respective tube, and the threads thereon cooperating with a said threaded opening in said upper back support rod, and said head capping its respective tube when said shank threadably engages said threaded opening.

6. A chair as recited in claim 1 wherein said back is further operatively supported by said first and second tube back perimeter-forming portions by an upper back support rod extending between said tube, with attachment means affixing said upper back support rod to said tubes, and snap connector means associated with said back for engaging said upper back support rod.

7. A chair as recited in claim 6 wherein said attachment means for said upper back support rod comprises: means defining a threaded opening in each end of said upper back support rod; a mechanical fastener for each tube, each fastener including a head and thread a threaded shank, said shank having a diameter small enough to fit within the interior cross-sectional dimensions of its respective tube, and the threads thereon cooperating with a said threaded opening in said upper back support rod, and said head capping its respective tube when said shank threadably engages said threaded opening.

8. A chair as recited in claims 1, 2, or 3 wherein said integral rod second support portion is received by said through-extending openings formed in said first and second tube front leg-forming portions.

9. A chair as recited in claim 1 wherein said seat and back are each an integral structure of molded plastic.

10. A chair as recited in claim 9 wherein said back and seat are operatively supported by said first and second tubes in part by pop rivets extending between said tubes and said seat and back.

11. A chair as recited in claim 9 wherein said seat member includes a generally flat top face and a bottom face; and wherein said bottom face includes integrally molded structural ribs formed therewith, said ribs being of varying thickness to provide relatively more flexibility for said seat member at central portions thereof, and relatively less flexibility of said seat member at perimeter portions thereof.

12. A chair comprising:

a first integral tube having a front leg-forming portion, seat perimeter-forming portion, and back perimeter-forming portion, said front leg-forming and back perimeter-forming portions being generally parallel to each other and generally perpendicular to said seat perimeter-forming portion;

a second integral tube substantially indentical to said first tube;

a first rear leg-forming rod;

a second rear leg-forming rod;

means defining an opening in each of said front leg-forming portion and back perimeter-forming portion of said first tube for receipt of said first rod;

means defining an opening in each of said front leg-forming portion and back perimeter-forming portion of said second tube for receipt of said second rod;

each of said first and second rods including a leg-forming portion and a support portion generally perpendicular to said leg-forming portion, and having inturned portions formed at the ends of said leg-forming and support portions, said inturned portions extending into said openings formed in said first and second tubes for receipt thereof, and said inturned portions being long enough so that said first and second rods are everywhere outside a volume defined by planes containing said first and second tubes, so that the chair is stackable with like chairs;

attachment means for affixing said rods to said tubes at the openings in said tubes for receipt of said rods;

a back operatively supported by said first and second tube back perimeter-forming portions;

a seat operatively supported by said first and second tube seat perimeter-forming portions;

at least one secondary support rod comprising an upper back support rod; and attachment means for affixing said upper back support rod to said first and second tubes at an opening in each of said tubes, comprising: means defining a threaded opening in each end of said upper back support rod, a mechanical fastener for each tube, said fastener including a head and a threaded shank, said shank having a diameter small enough to fit within the interior cross-sectional dimensions of its respective tube, and the threads thereon cooperating with a said threaded opening in said upper back support rod, and said head capping its respective tube when said shank threadably engages said threaded opening.

13. A chair as recited in claim 12 further comprising a plurality of secondary supports rods extending between said first and second tubes in addition to said upper back support rod; means for supporting said seat and back on said secondary support rods; means defining an opening in each of said first and second integral tubes for receipt of the ends of each of said secondary support rods; and attachment means for affixing each of said secondary rods to said first and second tubes at the opening in said tubes for receipt thereof.

14. A chair comprising:

a first integral tube having a front leg-forming portion, seat perimeter-forming portion, and back perimeter-forming portion, said front leg-forming and back perimeter-forming portions being generally parallel to each other and generally perpendicular to said seat perimeter-forming portion;

a second integral tube substantially identical to said first tube;

an integral rod including a pair of spaced parallel rear leg-forming portions adjacent the ends thereof, and first, second, and third support portions between said rear leg-forming portions, said first and third support portions being generally parallel to each other and generally transverse to said rear leg-forming portions, and said second support portion being generally transverse to said first and third support portions, and disposed therebetween;

means defining a through-extending opening in each of said first and second tube front leg-forming portions through which a support portion of said integral rod passes;

a back operatively supported by said first and second tube back perimeter-forming portions;

a seat operatively supported by said firsta and second tube seat perimeter-forming portions;

means defining an opening in each of said first and second integral tubes for passage of an end of said integral rod into said respective tube;

attachment means for affixing said integral rod to said first and second tubes at the openings in said tubes for receipt of said rod;

a plurality of secondary support rods extending between said first and second tubes;

means for supporting said seat and back on said secondary support rods;

means defining an opening in each of said first and second integral tubes for receipt of the ends of each of said secondary support rods; and attachment means for affixing said secondary rods to said first and second tubes at the opening in said tubes for receipt thereof; and wherein one of said secondary support rods comprises an upper back support rod; and wherein said attachment means for said upper back support rod comprises: means defining a threaded opening in each end of said upper back support rod; a mechanical fastener for each tube, each fastener including a head and a threaded shank, said shank having a diameter small enough to fit within the interior cross-sectional dimensions of its respective tube, and the threads thereon cooperating with a said threaded opening in said upper back support rod, and said head capping its respective tube when said shank threadably engages said threaded opening.

15. A chair as recited in claim 14 wherein each end of said integral rod comprises an inturned portion, said inturned portion passing into the opening formed therefor in either of said first or second tubes, and said inturned portion being long enough so that said first and third supports and said rear leg-forming portions are everywhere outside a volumne defined by planes containing said first and second tubes, so that the chair is stackable with like chairs.

* * * * *